US007811207B2

(12) United States Patent
Stearns et al.

(10) Patent No.: US 7,811,207 B2
(45) Date of Patent: Oct. 12, 2010

(54) EXERCISE METHODS AND APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 12/389,370

(22) Filed: Feb. 19, 2009

(65) Prior Publication Data

US 2009/0247370 A1 Oct. 1, 2009

Related U.S. Application Data

(63) Continuation of application No. 61/066,287, filed on Feb. 19, 2008.

(51) Int. Cl.
*A63B 22/04* (2006.01)

(52) U.S. Cl. ..... 482/52; 482/70

(58) Field of Classification Search ..... 482/51, 482/52, 53, 57, 70, 79, 80
See application file for complete search history.

(56) References Cited

U.S. PATENT DOCUMENTS

| | | | | |
|---|---|---|---|---|
| 6,277,054 | B1 * | 8/2001 | Kuo | 482/51 |
| 6,454,682 | B1 * | 9/2002 | Kuo | 482/52 |
| 6,620,079 | B2 * | 9/2003 | Kuo | 482/51 |
| 6,672,992 | B1 * | 1/2004 | Lo et al. | 482/52 |
| 2008/0227602 | A1 * | 9/2008 | Stearns et al. | 482/52 |
| 2008/0261778 | A1 * | 10/2008 | Chuang et al. | 482/52 |
| 2009/0111663 | A1 * | 4/2009 | Kuo | 482/53 |

* cited by examiner

*Primary Examiner*—Loan Thanh
*Assistant Examiner*—Tam Nguyen
(74) *Attorney, Agent, or Firm*—Nick A. Nichols, Jr.

(57) ABSTRACT

An exercise apparatus links rotation of a crank to generally elliptical motion of a foot supporting member. A foot supporting linkage is movably connected between a rocker and a crank in such a manner that the foot supporting member moves through paths of motion which are fixed, adjustable or variable.

8 Claims, 4 Drawing Sheets

EXERCISE METHODS AND APPARATUS

CROSS-REFERENCE TO RELATED APPLICATION

This application claims the benefit of U.S. Provisional Application Ser. No. 61/066,287, filed Feb. 19, 2008, which application is incorporated herein by reference.

BACKGROUND OF THE INVENTION

The present invention relates to fitness machines, and in particular a fitness machine which constrains the user's foot and/or arm to travel along a variable or fixed foot path.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY OF THE INVENTION

The present invention may be seen to provide a novel linkage assembly and corresponding exercise apparatus suitable for linking circular motion to relatively more complex, generally elliptical motion. Left and right cranks are rotatably mounted on a frame. A foot supporting linkage is movably connected between a rocker and the left and right cranks in such a manner that the foot supporting member moves through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
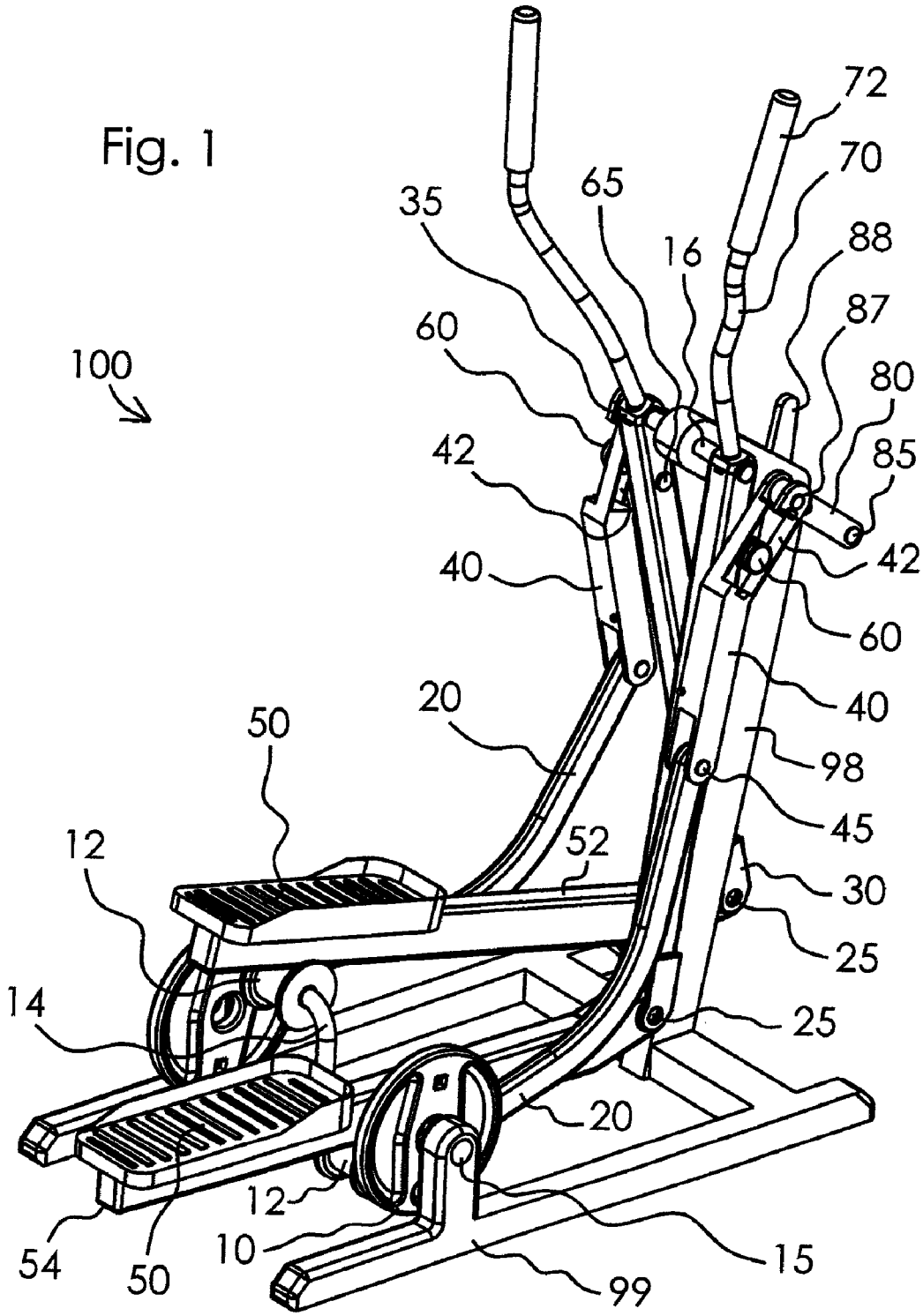
FIG. 1 is a perspective view taken from the rear of a first embodiment of the exercise apparatus of the present invention.

The present invention provides elliptical motion exercise machines which link rotation of left and right cranks to generally elliptical motion of respective left and right foot supports. The term "elliptical motion" is intended in a broad sense to describe a closed path of motion having a relatively longer major axis and a relatively shorter minor axis. In general, the present invention may be said to use displacement of the cranks to move the foot supports in a direction coincidental with one axis of the elliptical path, and displacement of crank driven members to move the foot supports in a direction coincidental with the other axis. A general characteristic of the present invention is that the crank diameter determines the length of one axis, but does not determine the length of the other axis. As a result of this feature, a person's feet may pass through a space between the cranks while nonetheless traveling through a generally elliptical path having a desirable aspect ratio, and the machines that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Figure 2:
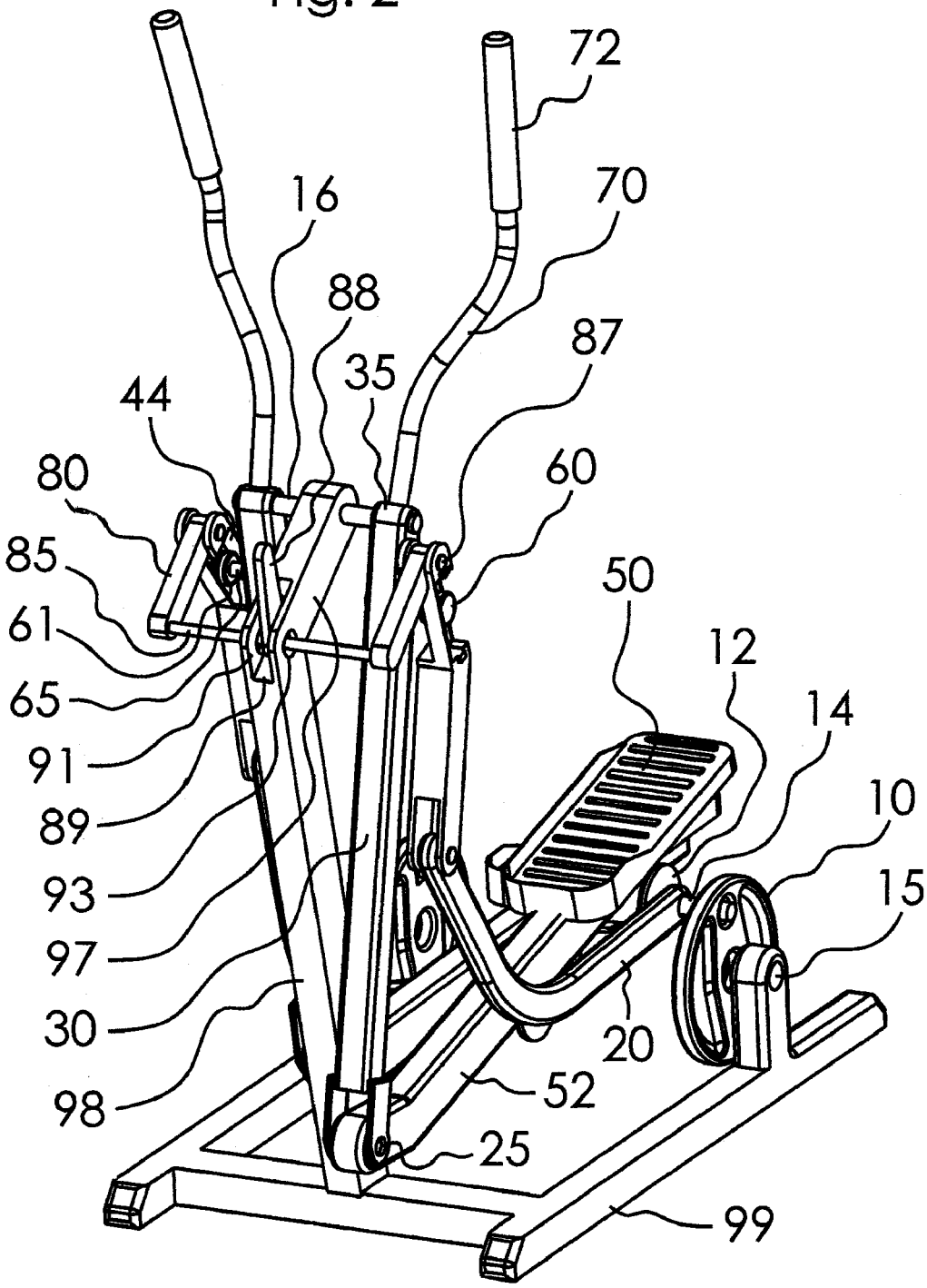
FIG. 2 is a perspective view taken from the front of the exercise apparatus of FIG. 1.

Referring first to FIGS. 1 and 2, a first embodiment of the exercise apparatus of the invention is generally identified by the reference numeral 100. The apparatus 100 includes a frame 99 that is designed to rest upon a floor surface. A stanchion 98 extends upward from a forward end of the base 99. The stanchion 98 includes an upper segment 97 that extends angularly upward toward a user positioned on the apparatus 100.

Left and right crank disks 10 are rotatably mounted on respective sides of the frame 99 at respective journals 15 proximate the rear end of the frame 99. A crank 14 is interconnected between the crank disks 10. Left and right rollers 12 are rotatably mounted on the crank 14 for orbital movement about the crank disks 10 axis and are concentric with the distal ends of drawbars 20 rotatably connected to the crank 14. Both crank disks 10 are shown in the form of disks, but crank arms may be used in the alternative. An advantage of using a crank disk is that it may be more readily connected to any of various known inertia altering devices, including, for example, a motor, a "stepped up" flywheel, an adjustable braking mechanism, or various combinations thereof.

Left and right drawbars 20 are pivotally connected to the crank 14 at rearward distal ends thereof. Each drawbar 20 includes an extension or lever member 40 that is pivotally connected to a forward distal end of the drawbar 20 at pin 45. The upper distal end of extension member 40 is formed by laterally offset oppositely facing race members 42 and 44 pivotally connected to a lever arm 80 at pin 87. A concentric pair of rollers 60 and 61, each being rotatably mounted about a respective shaft 65 connected to a respective rocker link 30 received between the race members 42 and 44. The rollers 60 and 61 engage the race members 42 and 44, respectively, in a manner which allows constant contact. Alternate designs may be utilized, such as non-concentric rollers, or mounting the rollers on pivot yoke members or the like.

Left and right rocker links 30 are pivotally mounted on respective sides of the stanchion 98. Each rocker link 30 extends generally downward from a rocker hub 35 that is pivotally connected to a transverse rocker shaft 16 fixed proximate the upper end of the stanchion 98. Handle bar members 70 are pivotally mounted on respective sides of the stanchion 98. Each handle bar member 70 extends generally upward from the rocker hub 35. The upper end of each handle bar member 70 includes a hand grip 72.

Referring again to FIG. 2, the stanchion 98 includes a recessed channel 89 at the juncture with the upper angled segment 97. The channel 89 is defined by upstanding stanchion flange members 91 that include aligned holes 93 extending therethrough. A transverse shaft 85 extends through the holes 93. The lower end of a handle 88 extends into the channel 89 and is rigidly fixed to the shaft 85. Left and right lever links 80 are fixedly secured to the transverse shaft 85 at one end and pivotally connected at the opposite ends thereof to race members 42 and 44 at pin 87.

Referring again to FIG. 1, left and right foot members 52 have forward ends that are pivotally connected to the lower ends of respective rocker links 30 and rearward portions that are supported on respective rollers 12 rotatably mounted on the crank 14. The rollers 12 are in rolling contact with the underside of the rearward portions of the foot members 52. Left and right foot supports 50 are mounted on the rearward portions of respective foot member 52.

In the embodiment of the apparatus 100 shown in FIGS. 1 and 2, the handle 88 may be adjusted by the user to adjust the stride foot path. In general, pulling the handle 88 back toward the user rotates the shaft 85 which in turn rotates the lever links 80 forcing the race members 42 and 44 to move downward relative to the rollers 60 which are fixedly secured to the rocker links 30 and thereby shortening the longitudinal component of the foot path P1 and the arm path Q1 illustrated in FIG. 3. The relative position of the rollers 60 to the race formed by the race members 42 and 44, as defined by the distance between lever link pin 87 and roller shaft 65, determines the longitudinal component of the foot path. During use of the apparatus 100, the rollers 60 move along a linear reciprocating path within the race defined by the race members 42 and 44. A longer linear path results in a longer longitudinal component of the foot path.

Figure 3:
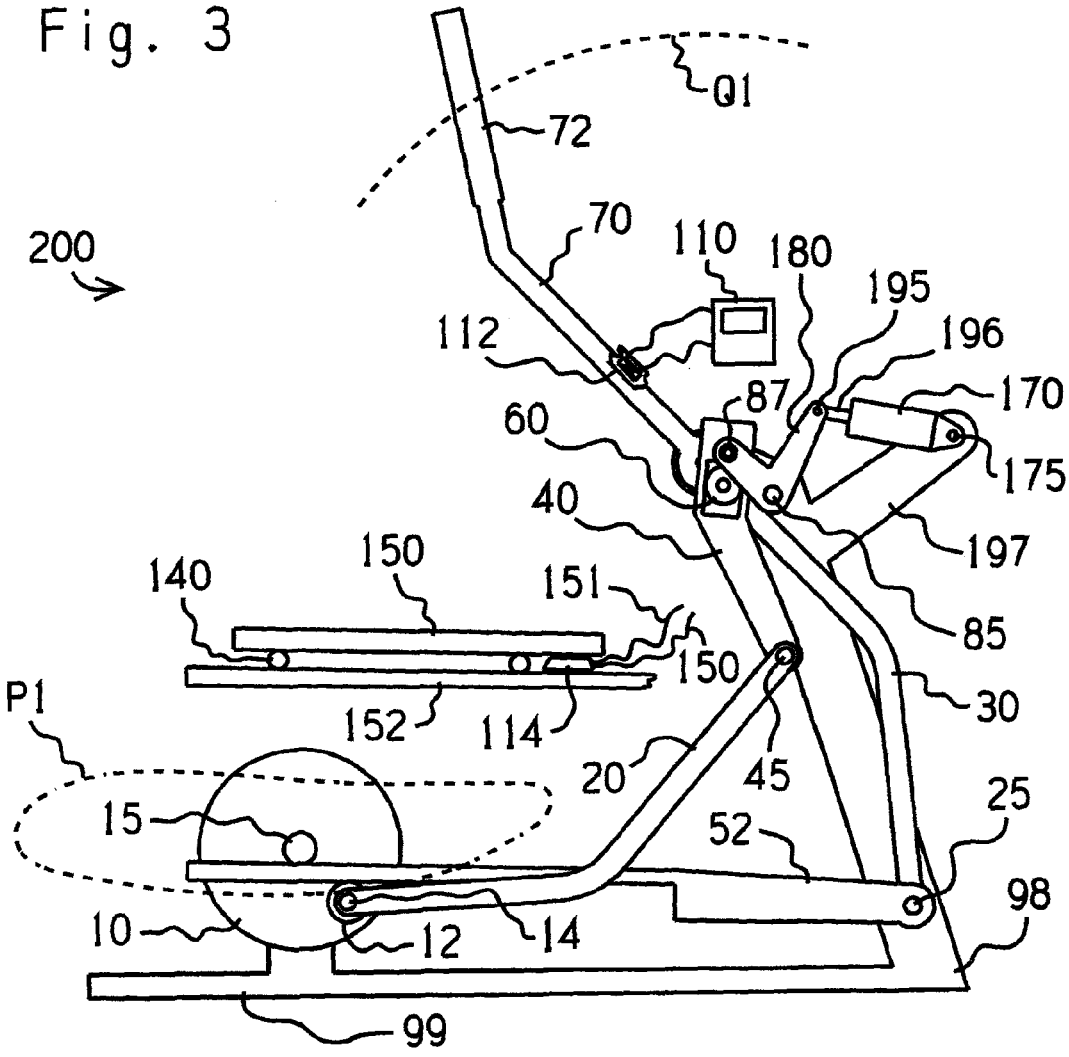
FIG. 3 is a side view of a second embodiment of the exercise apparatus of the present invention.
Figure 4:
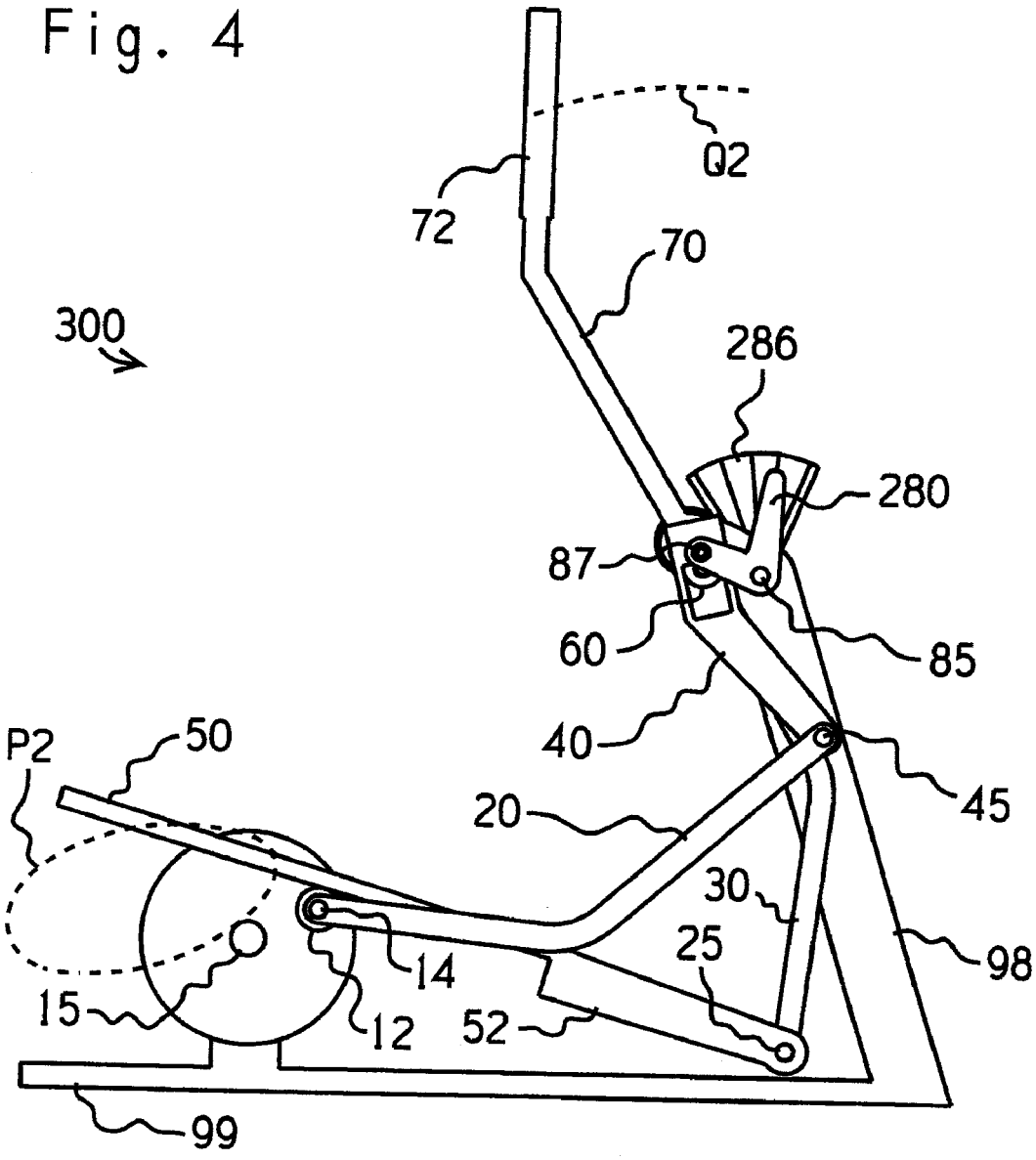
FIG. 4 is a side view of a third embodiment of the exercise apparatus of the present invention.

Adjusting the foot and arm paths may be better understood by referring first to FIG. 3, where it will be observed that the pivot axis defined by the pin 87 is relatively far from the pivot axis defined by the roller shaft 65 and thereby resulting in a relatively large foot path P1 and arm path Q1. In FIG. 4, the pivot axis defined by the pin 87 is relatively close to the pivot axis defined by the roller shaft 65 resulting in a relatively smaller foot path P2 and arm path Q2.

Referring again to FIG. 3, a second embodiment of the exercise apparatus of the invention generally identified by the reference numeral 200 is shown. The apparatus 200 is substantially the same as the apparatus 100 described above with the exception that the apparatus 200 includes an actuator 170 and a strain sensor 112. The actuator 170 is pivotally connected at pin 175 to the distal end of a support member 197 extending angularly upward and away from a user position on the exercise apparatus 200. The actuator may be a piston or the like having the distal end of a piston rod 196 pivotally connected to a link member 180. The opposite end of the link member 180 is fixedly secured to the shaft 85. The apparatus 200 may produce a variable foot path in response to force exerted by the user. The sensor 112 may be attached to the handle bar 70. Output signals from the sensor 112 may be transmitted to a console/computer operatively connected to the actuator 170. The sensor 112 generates an output signal proportional to the magnitude of the force exerted by the user on the handle bars 70. The output signal of the sensor 112 controls the movement of the piston rod 196 of the actuator 170 thereby adjusting the relative position of the pivot axis of pin 87 and roller shaft 65. For example, exerting greater force by the user on the handle bars 70 may result in an output signal from the sensor 112 to effect a retraction of the piston rod 196 which in turn moves the pivot axis of pin 87 relatively farther from the pivot axis of the roller shaft 65 thereby resulting in a longer stride foot path. Alternatively, the force exertion sensor, for example, sensor 114 may be located between the foot supports 50 and the foot member 52, thereby providing a sensor 114 output signal proportional to the magnitude of the user applied force in a longitudinal direction relative to the foot member 52.

Referring now to FIG. 4, a third embodiment of the exercise apparatus of the invention generally identified by the reference numeral 300 is shown. The apparatus 300 is substantially the same as the apparatus 100 described above with the exception that the apparatus 300 includes a manual adjusting lever 280 that may be manually locked against a frame plate 286. The frame plate 286 permits the user to lock the lever at intermediate points to effect a change in the foot and arm paths P2 and Q2.

While preferred embodiments of the invention have been shown and described, other and further embodiments of the invention may be devised without departing from the basic scope thereof, and the scope thereof is determined by the claims which follow.

The invention claimed is:

1. A variable motion exercise apparatus, comprising:

a) a frame designed to rest upon a floor surface;

b) a left crank and a right crank, wherein each said crank is mounted on a respective side of said frame and rotatable about a common crank axis;

c) a left rocker link and a right rocker link, wherein each said rocker link is mounted on a respective side of said frame and rotatable about a common pivot axis;

d) a left foot support linkage and a right foot support linkage, wherein each said foot support linkage is movably connected between a respective rocker link and a respective crank;

e) a left drawbar linkage and a right drawbar linkage, wherein said drawbar linkage is movably connected between a respective rocker link and a respective crank in such a manner that a foot supporting portion of each said foot supporting linkage is constrained to move through a generally elliptical path as a respective crank rotates, and each said drawbar linkage is selectively movable relative to a respective rocker link to alter a respective generally elliptical path;

f) wherein said drawbar linkage includes a first link and a second link which are pivotally connected to one another, and an opposite end of each said first link is rotatably connected to a respective crank and an opposite end of each said second link is pivotally connected to a respective rocker link; and g) wherein each said rocker link includes a roller mounted on a respective roller shaft, and wherein said rollers are in engaging contact with a linear race formed in each of said second link.

2. The exercise apparatus of claim 1, wherein said rollers are constrained to move through a reciprocal path defined by said linear race.

3. The exercise apparatus of claim 2, wherein said reciprocal path of said rollers is selectively adjusted to alter a respective generally elliptical path.

4. The exercise apparatus of claim 2, including a handle operatively connected to each of said second link wherein manipulation of said handle alters the reciprocal path of said rollers and said respective generally elliptical path.

5. The exercise apparatus of claim 2, including an actuator operatively connected to a control console and each of said second link for altering the reciprocal path of said rollers.

6. The exercise apparatus of claim 5, including sensor means operatively connected to said actuator, wherein said sensor means generate an output signal responsive to force exerted by a user on the handle bars of said apparatus, said output signal being transmitted to said actuator to alter the reciprocal path of said rollers.

7. The exercise apparatus of claim 6, wherein said sensor means is a strain sensor mounted on said handle bars.

8. The exercise apparatus of claim 5, including sensor means operatively connected to said actuator, wherein said sensor means generate an output signal responsive to force exerted by a user in a longitudinal direction relative to foot supports on the foot support linkage, said output signal being transmitted to said actuator to alter the reciprocal path of said rollers.

* * * * *